United States Patent [19]

Armstrong

[11] 3,945,697

[45] Mar. 23, 1976

[54] METHOD OF MANUFACTURING A PHOTOFLASH LAMP HAVING AN INDICATOR-INSULATOR

[75] Inventor: Donald E. Armstrong, Williamsport, Pa.

[73] Assignee: GTE Sylvania Incorporated, Danvers, Mass.

[22] Filed: Oct. 7, 1974

[21] Appl. No.: 512,772

Related U.S. Application Data

[62] Division of Ser. No. 406,389, Oct. 15, 1973, abandoned.

[52] U.S. Cl. ..... 316/17; 316/20

[51] Int. Cl.[2] ..... H01J 9/00

[58] Field of Search ..... 316/20, 24, 17; 431/13, 431/95

[56] References Cited

UNITED STATES PATENTS

| | | | |
|---|---|---|---|
| 2,071,369 | 2/1937 | Williams et al. | 431/95 |
| 2,726,527 | 12/1955 | Pipkin | 431/13 |
| 2,993,008 | 7/1961 | Anderson | 431/95 |
| 3,188,162 | 6/1965 | Anderson et al. | 316/20 |
| 3,195,326 | 7/1965 | Shaffer | 431/95 |
| 3,770,362 | 11/1973 | Shaffer | 431/13 |
| 3,816,054 | 6/1974 | Baldrige, Jr. | 431/95 |

FOREIGN PATENTS OR APPLICATIONS

| | | | |
|---|---|---|---|
| 584,463 | 10/1959 | Canada | 431/13 |
| 1,080,400 | 4/1960 | Netherlands | 431/13 |

*Primary Examiner*—Roy Lake
*Assistant Examiner*—James W. Davie
*Attorney, Agent, or Firm*—Edward J. Coleman

[57] ABSTRACT

A photoflash lamp having an hermetically sealed envelope containing a pair of lead-in wires spaced apart by a glass bead and having a glass insulator sleeve located about one of the lead-in wires between the bead and the inner end of the wire. A moisture indicating material is coated on portions of the lead-in wires and the glass sleeve for indicating by a change in coloration the presence of air contamination within the envelope and for insulating the lead-in wires to prevent preignition short circuits through filamentary combustible material located within the envelope. The indicating material comprises a mixture of cobaltous cobalticyanide and colloidal magnesium silicate, which composition tends to minimize pressure build up during flashing. The indicating material may be applied after sealing the ignition assembly into the glass tubing to be formed as the envelope by dipping a portion of the lead-in wires and glass insulator sleeve into a liquid preparation of the indicating material contained in a tube fitting through the open end of the glass envelope tubing.

4 Claims, 2 Drawing Figures

METHOD OF MANUFACTURING A PHOTOFLASH LAMP HAVING AN INDICATOR-INSULATOR

Figure 1:
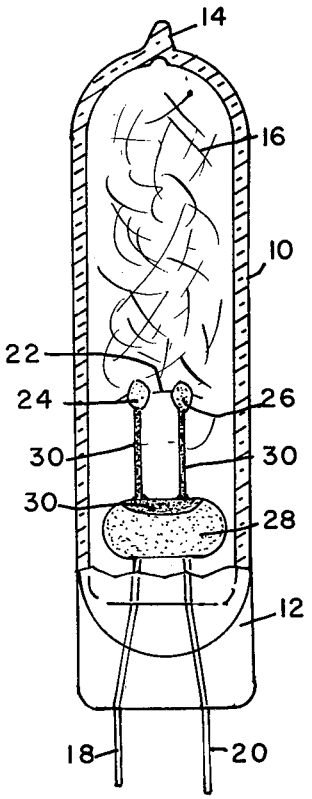

This is a division, of application Ser. No. 406,389 filed Oct. 15, 1973, now abandoned.

This invention relates in general to the manufacture of photoflash lamps and more particularly to flashlamps having means for determining the presence of air contamination within the sealed lamp envelope.

Photoflash lamps generate their actinic light output by the burning of an energetic fuel, such as finely shredded zirconium or hafnium metal foil, in a combustion supporting atmosphere, such as oxygen. The containing vessel, or envelope, for such combustion must be transparent and must be hermetically sealed so that a chosen atmospheric composition at a chosen stoichiometric balance will be present. Such lamp envelopes are most commonly made from glass. A crack or other defect in the envelope destroys its hermeticity and the resulting air contamination adversely affects the light output and timing characteristics of the flashlamp. Accordingly, it is common practice in the manufacture of photoflash lamps to apply a spot of moisture indicating material to the inner surface of the envelope to indicate, by a color change, whether or not the hermetic closure is intact. The material generally used for this purpose is cobaltous cobalticyanide, which in the anhydrous state is blue and which becomes pink when hydrated. The water vapor normally present in air effects a spot color change from blue to pink when the hermetic seal of the lamp envelope is broken.

As cobaltous cobalticyanide is a fine, water insoluble powder, it is mixed with a binder so that it will adhere to an interior surface of the sealed flashlamp. The usual method of applying the indicator material during the lamp manufacturing process is by use of a wire dip stick which is initially dipped into a fluid mixture of the cobaltous cobalticyanide and binder and then inserted into the glass envelope of the lamp to deposit a spot of the indicating paste on the inside surface thereof. In producing subminiature lamps having envelope volumes of less than, say, 0.5 cc., such a method of mechanical application becomes quite difficult.

Accordingly, it is an object of the invention to provide an improved photoflash lamp having a moisture indicator.

It is another object of the invention to provide an improved method for applying a moisture indicating material to subminiature size photoflash lamps.

In some of the tubular electrically ignitable photoflash lamps presently manufactured, the ignition means comprises a pair of lead-in wires sealed through one end of the tubular glass envelope and supported in a spaced side-by-side relation by a glass bead fused about the wires. Certain other lamp types additionally employ a glass insulating sleeve about one of the lead-in wires for preventing postignition short circuits. A tungsten filament is mounted across the inner ends of the two lead-in wires with the ends of the wires at their junctions with the filament being coated with a primer material, such as a powdered zirconium mixture. When battery current is applied to the external projecting portions of the two lead-in wires, the filament glows to incandescence, causing the primer material to ignite, which in turn ignites the finely shredded metallic combustible material in the lamp to produce a predetermined quantity of light output.

The primer on the ends of the lead-in wires is generally applied by a dipping method. A hollow tube containing a liquid mix of the primer may be introduced into the open end of the tubular shaped glass envelope, or the envelope may be lowered over a fixed primer containing tube, until the ignition structure is sufficiently coated with the primer material and then is withdrawn. In accordance with the present invention, the liquid indicator material is applied by a dip process similar to that of applying the primer and preceding the primer dipping process. The lamp ignition structure is dipped sufficiently deep into the moisture indicating material so that some of the material is deposited on portions of the lead-in wires and the glass insulating sleeve, or on a portion of the glass bead if no glass insulating sleeve is used. After sufficient drying of the indicator material, the assembly is then ready for the primer dip application which is applied partly over the indicator material on the ends of the lead-in wires.

By using this indicator material dip method and employing as the moisture indicating material a mixture substantially comprising cobaltous cobalticyanide and a colloidal magnesium silicate, as the binder, I have also discovered unexpected additional advantages which significantly enhance flashlamp operation. Firstly, in this manner of dip application, a coating of the indicator material is also deposited on the portions of the two lead-in wires which support the filament above the glass bead. The non-conductive properties of the thin coating of indicator material serve to prevent possible electrical short circuit contacts between the lead-in wires and the finely shredded strands of metallic combustible material prior to ignition. In cases where the electrical igniting current is weak, such as may occur as the result of weak batteries or a corrosion build-up on the contacts in the electrical ignition circuit, such shorting of electrical current away from the filament can result in lamps failing to flash. This problem becomes more significant in subminiature flashlamps, for as the lamp envelope size is made smaller, the oxygen pressure and the density of the combustible fill material are increased in order to maintain the desired light output. As a result of the denser packing of the shredded metallic combustible, a tighter metal-to-metal contact, and thus a better electrical contact, is provided between the strands of metal foil and the lead-in wires. By applying the moisture indicating material as taught by the invention, however, the critical portions of the lead-in wires are insulated to counteract this propensity of subminiature flashlamps toward preignition short circuits.

A second unexpected advantage is improved vessel containment during lamp flashing. Both the location and composition of the moisture indicating material contribute to this result. By coating the indicator material on the lead-in wires and insulating sleeve or bead instead of spotting the inner wall of the glass envelope, a possible hot spot source, due to oxidizing of the indicator material during ignition, is removed from the glass containing wall. Further, it has been observed that by using a substantially inorganic binder in an otherwise inorganic indicating material, a minimal amount of pressure build-up is produced during the flash cycle as compared to indicating materials employing an organic binder. Minimizing the pressure buildup, to thereby reduce the burden on the containing vessel wall, is particularly desirable in the case of subminiature size lamps, which typically employ relatively high fill pressures. In accordance with the invention, therefore, the moisture indicating material comprises a mixture of cobaltous cobalticyanide and a binder which substantially comprises a colloidal magnesium silicate. While I prefer to use magnesium montmorillonite as the binding agent, other colloidal magniesum silicates, such as for example lithium-magnesium silicate and aluminium-magnesium silicate, may also be employed satisfactorily.

Figure 2:
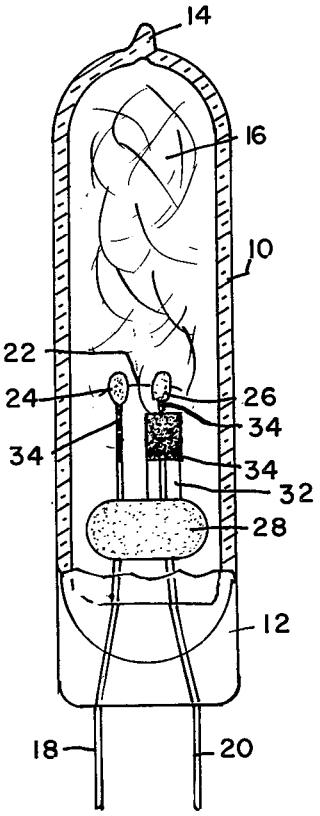

In the accompanying drawings,

FIG. 1 is an elevational view, partly in section, of one type of photoflash lamp provided with a moisture indicator in accordance with the principles of this invention; and FIG. 2 is an elevational view, partly in section, of another type of photoflash lamp provided with a moisture indicator in accordance with the invention.

Referring to FIG. 1, one embodiment of the invention is illustrated as applied to an electrically ignitable photoflash lamp having a pair of filament-supporting lead-in wires supported by a glass bead. The lamp comprises an hermetically sealed, light transmitting envelope 10 of glass tubing having a press 12 defining one end thereof and an exhaust tip 14 defining the other end thereof. A quantity of filamentary combustible material 16, such as shredded zirconium or hafnium foil, is located within the lamp envelope. The envelope 10 is also provided with a filling of combustion-supporting gas, such as oxygen, at a pressure of several atmospheres.

The ignition means comprises a pair of lead-in wires 18 and 20 extending through and sealed into the press 12. A filament 22 spans the inner ends of the lead-in wires, and beads of primer 24 and 26 are located on the inner ends of the lead-in wires 18 and 20 respectively, at their junctions with a filament. The lead-in wires are supported in a spaced side-by-side relation by a glass bead 28 fused about the wires. In accordance with the invention, a substantially inorganic moisture indicating material 30 is coated on a portion of the glass bead 28 and the portion of the lead-in wires extending from the glass bead toward the filament.

FIG. 2 illustrates another embodiment of the invention as applied to a flashlamp identical to that of FIG. 1 except that it further includes a glass sleeve 32 disposed about a portion of one of the lead-in wires (20) as an insulating shield extending from the glass bead toward the filament for preventing post-ignition short circuits across the lead-in wires. Such a feature is required for the proper operation of certain flash sequencing circuitry for controlling linear arrays of flashlamps. Further, in FIG. 2, a coating of moisture indicating material 34 is disposed on a portion of the glass sleeve 32 and at least portions of the lead-in wires extending toward the filament. As described hereinbefore, the moisture indicating material comprises a mixture of cobaltous cobalticyanide and a colloidal magnesium silicate, preferably magnesium montmorillonite.

In the manufacture of photoflash lamps of the type described, the lamp envelope 10 is initially a segment of glass tubing, open at both ends. The ignition assembly (or mount structure), which comprises filament 22, lead-in wires 18 and 20 and glass bead 28 (and, in FIG. 2, further includes glass sleeve 32), is located within the glass tubing with the free ends of the lead-in wires projecting from one of the open ends of the tubing. A press seal 12 is then formed to close the end of the tubing from which the wires project. Next, a portion of the ignition assembly within the glass tubing is dipped into a liquid preparation of moisture indicating material contained in a tube which fits through the open end of the glass tubing. That is, a hollow tube containing a liquid mix of the indicator material may be introduced into the remaining open end of the glass tubing, or the glass tubing may be lowered over a fixed tube containing the indicator liquid. The ignition assembly is dipped sufficiently deep into the liquid indicator material so that some of the material is deposited on the glass bead 28, or, in the lamp of FIG. 2, it may be dipped fully or partially onto the glass sleeve 32. After sufficient drying of the indicator material coatings 30 or 34, the end portions of the lead-in wires within the glass tubing are dipped into a liquid preparation of primer, which is applied partly over the indicator material on the lead-in wires. Thereafter, the primer beads 24 and 26 are dried and a charge of combustible material, such as shredded zirconium or hafnium foil, is introduced into the remaining open end of the tubing. The glass is then constricted at the open end, and the envelope is exhausted, filled with oxygen gas at several atmospheres pressure, and tipped off at 14 to define an hermetically sealed envelope.

Thereafter, the coatings of dried paste 30 or 34, which normally have a blue appearance, function to indicate, by a change in coloration to pink, the presence of an air leak in the envelope. The coatings on bead 28 and sleeve 32 are particularly suitable as indicators as they are easily visible. In addition, the nonconductive indicator material 30 or 34 insulates critical portions of the lead-in wires 18 and 20 sufficiently to prevent pre-ignition short circuits through the metallic shreds 16. There is a little likelihood of a short below the glass bead as the mass of shreds 16 are generally disposed above bead 28. Finally, by employing a substantially inorganic indicator material composition, pressure buildup during ignition is minimized, and this feature together with an indicator location away from the glass envelope wall results in improved containment during flashing.

Although the invention has been described with respect to specific embodiments, it will be appreciated that modifications and changes may be made by those skilled in the art without departing from the true spirit and scope of the invention. For example, the invention is also applicable to other types of electrically ignitable lamps, such as those having spark gap or primer bridge ignition structures.

What I claim is:

1. A method of making a photoflash lamp comprising:

locating an ignition assembly including a pair of lead-in wires within a length of glass tubing with said lead-in wires projecting from one end of the tubing;

sealing the end of the glass tubing from which said lead-in wires project;

dipping a portion of the ignition assembly within said glass tubing into a liquid preparation of moisture indicating material comprising a mixture of cobaltous cobalticyanide and a colloidal magnesium silicate, said moisture indicating liquid being contained in a tube which fits through the open end of said glass tubing during said dipping step;

drying the moisture indicating material thereby coated on said ignition assembly;

dipping end portions of the lead-in wires within said glass tubing into a liquid preparation of primer, and after drying of the primer beads thereby formed, filling the glass tubing with a quantity of filamentary combustible material and a combustion-supporting gas, and tipping off the tubing to provide an hermetically sealed envelope.

2. The method of claim 1 wherein said ignition assembly further includes a glass bead fused about said lead-in wires for supporting said lead-in wires in a spaced side-by-side relation, and said step of dipping a portion of said ignition assembly into said moisture indicating liquid provides a coating of said moisture indicating material on a portion of said glass bead and the portions of said lead-in wires extending from said glass bead toward the open end of said tubing.

3. The method of claim 1 wherein said ignition assembly further includes a glass bead fused about said lead-in wires for supporting said lead-in wires in a spaced side-by-side relation, and a glass sleeve disposed about a portion of at least one of said lead-in wires and extending from said glass bead toward the open end of said tubing, and said step of dipping a portion of said ignition assembly into said moisture indicating liquid provides a coating of said moisture indicating material on a portion of said glass sleeve and portions of said lead-in wires extending toward the open end of said tubing.

4. The method of claim 3 wherein said moisture indicating material comprises a mixture of cobaltous cobalticyanide and magnesium montmorillonite.

* * * * *